US005235314A

United States Patent [19]

Whetzal, Jr.

[11] Patent Number: 5,235,314

[45] Date of Patent: Aug. 10, 1993

[54] WARNING DEVICE FOR CONCRETE FINISHING TOOL

[76] Inventor: John L. Whetzal, Jr., P.O. Box 243, Westmont, Ill. 60559

[21] Appl. No.: 815,823

[22] Filed: Dec. 30, 1991

[51] Int. Cl.[5] ..... G08B 21/00

[52] U.S. Cl. ..... 340/321; 15/235.3; 340/326

[58] Field of Search ..... 116/307, 67 R; 200/61, 200/85, DIG 2; 15/235.3; 340/321, 669, 326

[56] References Cited

U.S. PATENT DOCUMENTS

| | | | |
|---|---|---|---|
| 1,585,970 | 5/1926 | Fischer | 200/DIG. 2 |
| 2,168,671 | 8/1939 | Garlington | 340/321 |
| 3,226,704 | 12/1965 | Petrash | 340/669 X |
| 3,383,675 | 5/1968 | Allardice et al. | 340/321 |
| 4,789,762 | 12/1988 | Miller et al. | 200/61.45 R |
| 4,959,637 | 9/1990 | Woods et al. | 340/326 X |

FOREIGN PATENT DOCUMENTS

| | | | |
|---|---|---|---|
| 2755835 | 7/1978 | Fed. Rep. of Germany | 340/321 |
| 2720972 | 11/1978 | Fed. Rep. of Germany | 340/321 |

*Primary Examiner*—Daniel M. Yasich

*Attorney, Agent, or Firm*—Margaret Marsh Parker and Assoc.

[57] ABSTRACT

A warning or alerting device for a manually operated, concrete finishing tool may provide a flashing light, a beeping signal or both when the tool is being operated. The device may be attached to the extended handle of the tool. Use of the warning device will help prevent injury to coworkers or bystanders from the long handle of the tool as the working end of the tool is drawn back toward the operator.

11 Claims, 2 Drawing Sheets 58B
32
46
36
30
38
38
8
44
58A
54
56A
52
57
20
34
30
32
58A
57
32
46
30
38
48
58A
54
52
60
56B
64
20
34
30
32
58A
64

WARNING DEVICE FOR CONCRETE FINISHING TOOL

BACKGROUND OF THE INVENTION

This invention relates to the field of manually operated tools for use in the finishing of concrete surfaces and, in particular, to a warning device for the prevention of injury to a co-worker or bystander from the finishing tool handle.

In the field of concrete construction of large horizontal surfaces such as roads, floors and bridge surfaces, the tool most commonly used for the final smoothing of the surface is known as a "float", the larger "bull float" or even larger "Texas float". The smoothing technique involves pushing out and pulling back on the float handle while keeping an extremely vigilant eye on the surface being smoothed. In the case of the bull float or Texas float, the handle may be more than twenty feet in length. Due to the angle of operation, the end of the handle is typically at the level of a person's upper torso or head as the handle nears the end of a stroke. While a "hard hat" provides some protection, injuries have occurred even to co-workers but especially to bystanders who do not realize the potential danger. Since a construction environment is typically very noisy, and the operator of the float cannot take his eyes off the concrete surface, he is often not aware of people behind him until an accident occurs. It is, therefore, evident that there exists a serious need for some means of alerting those in the immediate area of the potential danger. No such device is known at present.

SUMMARY OF THE INVENTION

It is an object of the present invention to provide a warning device for attachment to the end of the tool's long handle.

It is a particular object to provide such a device which can be operated by the tool operator or which can operate automatically.

It is another object to provide such a device which can alert a co-worker or bystander audibly, visually or both as desired.

These objects and others which may become apparent are obtained in accordance with the present invention by an alerting device which is attached to the outer end of the tool's handle. The device will be enabled either by the operator as he uses the tool or will be automatically enabled by the backward motion. When enabled, the device will emit either a warning sound, a visual signal or both.

DETAILED DESCRIPTION OF THE PREFERRED EMBODIMENT

Figure 1:
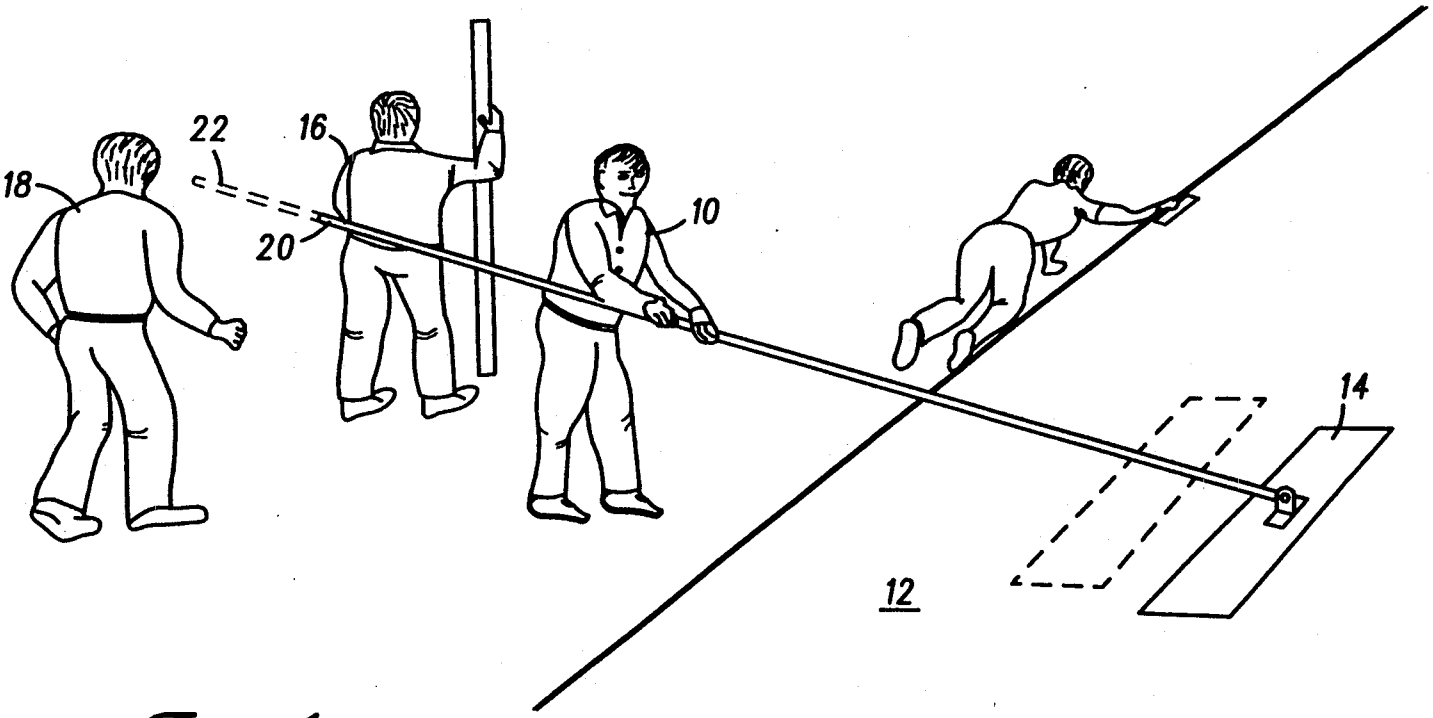
FIG. 1 is an overall view of the device as it would be used in a working situation.

FIG. 1 shows an operator 10 smoothing a portion 12 of a large concrete surface using a bull float 14. A co-worker 16 and a bystander 18 are also seen in the vicinity of the float 14 but not in the field of vision of the operator 10. It will be seen that when a handle 20 of the float 14 is drawn back to a dotted line position 22, the bystander 18 could conceivably be injured by the handle 20 if not alerted to the backward motion by an alerting device 30 (see FIGS. 2A, 2B, 3A or 3B). Even the co-worker's hard hat will not provide sufficient protection, especially for his face.

Figures 2A, 2B, 3A, 3B:
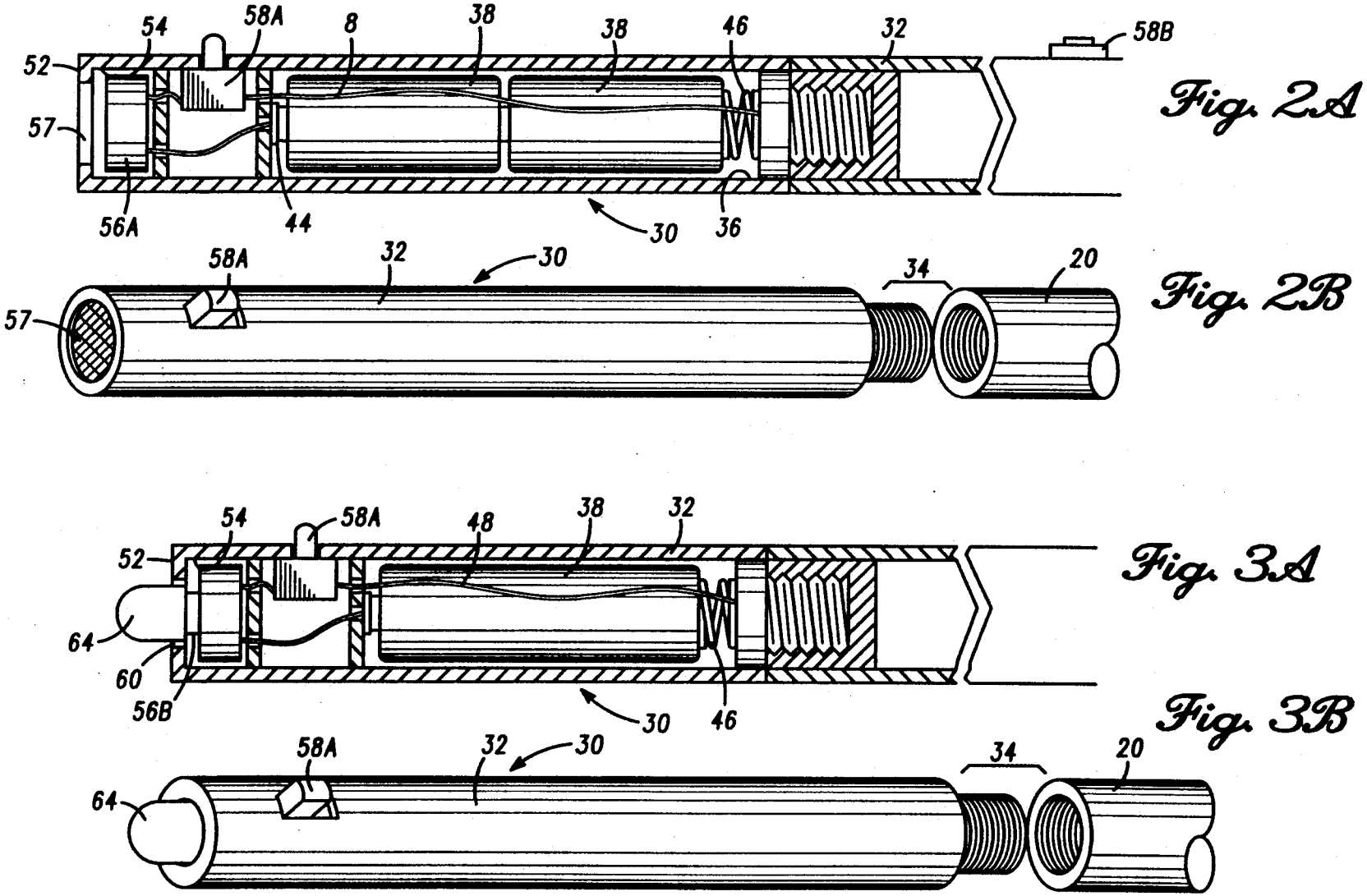
FIGS. 2A and 2B are a perspective view and a cutaway view, respectively, of one embodiment of the device of the invention.
FIGS. 3A and 3B are a perspective view and a cutaway view, respectively, of another embodiment of the device of the invention.

In FIGS. 2A and 2B one embodiment of the device 30 is seen in a perspective view and a cutaway view which will be described together. An outer shell or housing 32 would preferably be made of metal in cylindrical form. One end of the shell 32 would include an arrangement 34 for attachment to the handle 20 of the float 14. The attaching arrangement is shown here as a screw-in arrangement, but could be of any suitable, sturdy, easily attached and detached design.

Within the shell 32 is a compartment 36 for releasably containing an electrical power source 38 such as a series of "D" cells, however, any other suitable power source could be used. The compartment 36 may include a fixed contact 44 and a spring contact 46 which make contact with the positive and negative connections respectively of the power source 38. The contact 46 would include a wire 48 sufficient in length for allowing the opening of the shell as for battery replacement.

In the outermost end 52 of the shell 32, is another compartment 54 for containing alerting unit 56. The unit 56 will preferably provide a periodic high frequency, audio signal such as a constant "beep" when activated or a periodic visible signal such as a flashing light as in FIGS. 3A and 3B or both types of signal. If an audible signal is used, it must be of such a nature and loudness as to be readily heard, even in a noisy construction site environment. In this instance, the device 30 would include a "beeper" or other audio unit and access for the sound through an aperture 57, preferably screened, in the shell 32.

Also contained within or on the shell 32 is a switching device 58A. The device 58A is illustrated as a SPST toggle switch positioned for being enabled by the thumb of the operator 10 as he begins to use the float. In another embodiment, the switching device could include another switching portion 58B positioned on the handle 20 nearer the working end of the tool and coupled to the first switching portion 58A, so that the operator 10 could activate the alerting device 30 as he draws the float 14 back toward him, and deactivate the device 30 as the float is moved forward. In this embodiment, the switching portions 58A and 58B would preferably be DPDT switches as is known in the art. However, it will be apparent that the switching device 58 could alternatively be of the type enabled automatically by the momentum of the backward motion of the float 14. Such devices are well known and the specific type is not significant to the invention. It is to be noted that the alerting device 30 may operate continuously whenever the float is being utilized, or be enabled only when specific danger is present, as during the drawing back of the handle 20.

FIGS. 3A and 3B show another embodiment of the device 30 is seen in a perspective view and a cutaway view. The embodiment would include most of the same components as in FIG. 2, but instead of the screened aperture 57, the outer end of the compartment 54 of the shell 32 would contain an aperture 60 and instead of the audible alerting unit 56A as seen in FIG. 2, will include a visible alerting unit 56B, preferably providing a flashing light, and a lens or light transmitting cover 64, preferably red.

It will be apparent that the embodiments of FIGS. 2A, 2B and 3A, 3B could well be combined in one device, and operated with the same switching arrangement 58.

Thus there has been shown and described an alerting device for the prevention of possible injury to bystanders or co-workers from the long handle of a bull float as used in the concrete finishing industry. The device may utilize either a visual or audible alerting signal or both types. The device may be enabled by the operator or automatically by the motion of the finishing tool. Other variations and modifications of the device are possible, and it is intended to cover all such as fall within the scope of the appended claims.

What is claimed is:

1. A warning device for the prevention of injury to a nearby person by an extended handle of a manually operated, concrete finishing tool, said device comprising:

alerting means on the outer end of said extended handle for selectively providing a perceptible and periodic alerting signal during at least a portion of the back and forth operation of said finishing tool;

power source for supplying power to operate said alerting means;

switching means for enabling said alerting means; and housing means for containing said alerting means and said power source.

2. A warning device according to claim 1 and further including means for attaching said housing means to the handle of the concrete finishing tool.

3. A warning device according to claim 2 wherein said alerting means provides a visible signal clearly perceptible in the vicinity of said tool.

4. A warning device according to claim 3, wherein said visible signal is a periodic signal.

5. A warning device according to claim 2 wherein said alerting means provides both an audio signal clearly audible in the vicinity of said tool and a visible signal clearly perceptible in the vicinity of said tool.

6. A warning device according to claim 1 and further including means for attaching said housing means to the outer end of the handle of said concrete finishing tool.

7. A warning device according to claim 1 wherein said power source comprises at least one battery.

8. A warning device according to claim 1 wherein said switching means comprises two portions, a first portion positioned at said housing for enabling said alerting device and the other portion positioned closer to the working end of said concrete finishing tool for disenabling said device.

9. A warning device according to claim 1 wherein said switching means is enabled automatically by the motion of said concrete finishing tool.

10. A warning device according to claim 1 wherein said alerting means provides an audio signal clearly audible in the vicinity of said tool.

11. A warning device according to claim 1 and wherein said housing means further contains said switching means.

* * * * *